US010724126B2

(12) United States Patent
Li et al.

(10) Patent No.: US 10,724,126 B2
(45) Date of Patent: Jul. 28, 2020

(54) HIGH HARDNESS AMORPHOUS COMPOSITE AND PREPARATION METHOD AND APPLICATION THEREOF

(71) Applicants: DONGGUAN EONTEC CO., LTD., Dongguan (CN); DONGGUAN MEIANMEIYE TECHNOLOGY CO., LTD., Dongguan (CN)

(72) Inventors: Yangde Li, Dongguan (CN); Tiezhuang Tang, Dongguan (CN); Weirong Li, Dongguan (CN)

(73) Assignee: DONGGUAN EONTEC CO., LTD., Dongguan (CN)

( * ) Notice: Subject to any disclaimer, the term of this patent is extended or adjusted under 35 U.S.C. 154(b) by 307 days.

(21) Appl. No.: 15/766,008

(22) PCT Filed: Jun. 22, 2016

(86) PCT No.: PCT/CN2016/086646
§ 371 (c)(1),
(2) Date: Apr. 5, 2018

(87) PCT Pub. No.: WO2017/080211
PCT Pub. Date: May 18, 2017

(65) Prior Publication Data

US 2019/0112695 A1 Apr. 18, 2019

(30) Foreign Application Priority Data

Nov. 13, 2015 (CN) ..... 2015 1 0785916

(51) Int. Cl.

| | |
|---|---|
| ***C22C 45/10*** | (2006.01) |
| ***C22C 1/02*** | (2006.01) |
| ***C22C 32/00*** | (2006.01) |
| ***C22C 1/10*** | (2006.01) |
| ***C22F 1/18*** | (2006.01) |

(52) U.S. Cl.
CPC ..... *C22C 45/10* (2013.01); *C22C 1/02* (2013.01); *C22C 1/1036* (2013.01); *C22C 32/00* (2013.01); *C22C 32/0052* (2013.01); *C22F 1/186* (2013.01); *C22C 2200/02* (2013.01)

(58) Field of Classification Search
CPC ..... C22C 1/02; C22C 45/10
See application file for complete search history.

(56) References Cited

U.S. PATENT DOCUMENTS

| | | | | |
|---|---|---|---|---|
| 9,896,753 | B2 * | 2/2018 | Fu | C22F 1/186 |
| 2019/0112695 | A1 * | 4/2019 | Li | C22C 1/02 |

* cited by examiner

*Primary Examiner* — Scott R Kastler
(74) *Attorney, Agent, or Firm* — Shimokaji IP

(57) ABSTRACT

The present invention relates to a high hardness amorphous composite, a method of preparing the high hardness amorphous composite and application thereof. The high hardness amorphous composite includes a basic alloy component, a hard additive and a bonding additive. The basic alloy component includes 45-60 mole % Zr, 5-10 mole % Hf, 5-15 mole % Al, 8-22 mole % Ni and 6-14 mole % Cu, the hard additive is ZrC or WC nanometer powder with addition amount at 12-26 wt % of the basic alloy component, particle diameter of the WC nanometer powder is 10-100 nm, and the bonding additive is any one or two selected from groups of Re, W or Mo with addition amount at 4-8 wt % of the basic alloy component. The high hardness Zr-based amorphous composite with good workability and formability is provided by improving composition of alloy based on Zr—Al—Ni—Cu, adding new component and adjusting component content.

8 Claims, No Drawings

HIGH HARDNESS AMORPHOUS COMPOSITE AND PREPARATION METHOD AND APPLICATION THEREOF

RELATED APPLICATIONS

This application claims the benefit of priority to Chinese Patent Application No. 201510785916.7 filed in Nov. 13, 2015, which is hereby incorporated by reference in its entirety.

FIELD OF THE INVENTION

The present invention relates to a field of amorphous composite, more particularly to a high hardness amorphous composite, a method of preparing the high hardness amorphous composite and application thereof.

BACKGROUND OF THE INVENTION

Amorphous alloy atoms array in non-periodic and non-translational symmetry and bond orderly with adjacent atoms in the 1-2 nm micro-scale, so amorphous alloy has various excellent properties, such as high strength, high elasticity, good corrosion resistance, etc., which make amorphous alloy have very broad application prospect. Thus, how to further improve performance of amorphous alloy is an important study.

Hardness is an important performance index of metal, which relates closely to resist elastic deformation, plastic deformation or damage capability, and is comprehensive characterization of mechanical properties such as elasticity, plasticity, strength and toughness. In order to enhance hardness of amorphous alloy, a lot of researches have been done. At present, amorphous alloy matrix is mainly made of refractory metals such as W—Fe—B, Mo—Ru—Si or W—Ru—B—Hf. But due to alloy composition, amorphous alloy is not only formed with difficulty, and difficult to process by thermoforming methods, so such materials cannot be used widely. Some technical solutions are already used to address these shortcomings, such as Chinese Patent, application No. 201410769681.8 entitled "Re—B-M Amorphous Alloy with High Hardness and Preparation Method thereof", which obtains amorphous alloy with higher hardness and wider supercool liquid phase region by adding transition metal elements Co or Fe to Re—B alloy. However, refractory metals are also used in this research, which does not significantly improve processing molding of amorphous alloy.

Thus it's necessary to provide a high hardness amorphous composite and its preparation method, which can improve improvements range and processing molding of amorphous alloy.

SUMMARY OF THE INVENTION

One objective of the present invention is to provide a high hardness Zr-based amorphous composite with good workability and formability by improving composition of alloy based on Zr—Al—Ni—Cu, adding new component and adjusting component content.

To achieve the above objective, a high hardness amorphous composite is provided, which includes a basic alloy component, a hard additive and a bonding additive. The basic alloy component includes 45-60 mole % Zr, 5-10 mole % Hf, 5-15 mole % Al, 8-22 mole % Ni and 6-14 mole % Cu, the hard additive is ZrC or WC nanometer powder with addition amount at 12-26 wt % of the basic alloy component, particle diameter of the WC nanometer powder is 10-100 nm, and the bonding additive is any one or two selected from groups of Re, W or Mo with addition amount at 4-8 wt % of the basic alloy component.

Preferably, the basic alloy component includes 54-58 mole % Zr, 6-8 mole % Hf, 10-15 mole % Al, 15-20 mole % Ni and 8-12 mole % Cu.

Zr-based amorphous alloy is currently one of the most widely used amorphous alloys. Due to good formability and easy to get alloy raw material, Zr—Al—Ni—Cu quaternary alloy is one of the most widely used Zr-based amorphous alloys. Content of four elements of Zr, Al, Ni and Cu in the basic alloy component is adjusted, and 5-10 wt % Hf is added to the basic alloy component in the invention. Hf is a congener element of Zr that can substitute Zr in the smelting process so that force between Zr atom in the alloy and other element atoms is enhanced and close-packed structure of amorphous alloy composite is more stable, making amorphous alloy composite more dense macroscopically. Zr—Al—Ni—Cu—Hf five-element alloy as a basic alloy can not only ensure formation ability of the amorphous alloy, but also have good melt coating property and is well integrated with the hard additive and the bonding additive added.

The inventor of the present invention finds in practice that adding ZrC or WC nanometer powder can effectively increase hardness of Zr—Al—Ni—Cu—Hf-based amorphous alloy. However, addition of ZrC or WC nanometer powder alone will cause alloy to explode during smelting, which can be avoided when one or both of Re, W and Mo elements are properly added. ZrC or WC nanometer powder in the Zr-based amorphous alloy bonds with disordered metal bonds in the alloy system and forms a crystal-like structure. The disordered structures can act as a buffer to prevent deformation expansion caused by the external force when substrate is subjected to external force so as to enhance impact resistant and resisting deformation capability, namely enhancing hardness of amorphous composite. If particle size of ZrC or WC nanometer powder is too large, it is difficult to be integrated into alloy. If particle size is too small, cost of raw material will be increased. In the present invention, particle size of nanometer powder is preferably 10-100 nm.

Preferably, the hard additive is ZrC nanometer powder with addition amount at 12-18 wt % of the basic alloy component. Addition of ZrC nanometer powder not only enhances the hardness of the alloy system, but also does not introduce other impurity elements into the Zr-based amorphous alloy, avoiding alloy crystallization resulting from addition of excessive elements.

Re and W are the same periodic elements of Hf, Mo is the same periodic element of Zr, and structure and electricity of Re, W and Mo atoms are very similar to those of Zr and Hf atoms. Re, W or Mo atoms can substitute Zr or Hf in the alloy system, enhancing bonding force between atoms in the alloy system, which can act as a binder in the alloy system and make the basic alloy component combine more closely with ZrC or WC nanometer powder to avoid alloy cracking during smelting process. Meanwhile, adding Re, W or Mo element can also increase entropy of amorphous alloy system and enhance formation ability of amorphous alloy.

Preferably, the bonding additive is Re with addition amount at 8 wt % of the basic alloy component.

Concretely, the high hardness amorphous composite further includes B or Si with content at 0.5-2 wt % of the basic alloy component to further enhancing hardness of the amorphous composite.

Preferably, the high hardness amorphous composite further includes Nd with content at 0.5-2 wt % of the basic alloy component to improve formation ability of the amorphous alloy.

The present invention also provides a method of preparing a high hardness amorphous composite, used in mass production, and the method includes:

step a, weighing the basic alloy component, the hard additive and the bonding additive according to formulation ratio, mixing the hard additive and the bonding additive evenly to obtain a mixed raw material, then placing the mixed raw material on the bottom of the basic alloy component to obtain a pending alloy raw material; and step b, smelting the pending alloy raw material by means of electric arc melting in an inert atmosphere of 0.01-0.05 MPa, and the smelting being conducted in a first process and a second process: the first process comprising controlling working current of electric arc in 10-50 A and heating the pending alloy raw material until the pending alloy raw material melts into a liquid, the second process comprising increasing the working current of electric arc to 200-900 A to mix the liquid of the pending alloy raw material evenly; and step c, molding and cooling the liquid of the pending alloy raw material at $10^2$-$10^3$ K/s to obtain an amorphous composite ingot.

The inventor of the present invention finds in practice that ZrC or WC nanometer powder as the hard additive is not well-mixed with the basic alloy component, and the amorphous alloy obtained by directly mixing all the raw materials by conventional methods is liable to burst. According to the method in the present invention, the hard additive is mixed with the bonding additive and then placed on the bottom of the basic alloy component to obtain the pending alloy raw material. The pending alloy raw material is smelt in the first process into liquid state in an inert atmosphere of 0.01-0.05 MPa by means of electric arc melting under 10-50 A current, to enhance the fluidity, the liquid basic alloy component slowly covers the ZrC or WC nanometer powder as the hard additive, and the bonding additive gradually fuses with the ZrC or WC nanometer powder after melting. After the pending alloy raw material is initially fused and then smelted in the second process under 200-900 A current to make the liquid alloy raw material mix quickly and evenly.

Preferably, the second process is repeated one or two times so that the pending alloy raw material is uniformly mixed.

Preferably, in the step c, the amorphous composite ingot is molded by a conventional die-casting process or a conventional suction casting process.

The preparation conditions of the amorphous composite in the present invention are similar to those of the conventional amorphous composite, namely the inert atmosphere pressure is 0.01-0.05 MPa, and cooling rate is $10^2$-$10^3$ K/s.

The present invention also provides a method of preparing consumer electronics, medical device products, aerospace industrial products, industrial instrumentation products, automotive industry products, jewelry industry products or decorative industry products, which includes using the high hardness amorphous composite mentioned above.

In comparison with the prior art, the high hardness Zr-based amorphous composite in the present invention has good workability and formability by improving composition of alloy based on Zr—Al—Ni—Cu, adding new component and adjusting component content. The amorphous composite forms up to 22 mm in size and is suitable for making complex structural parts. Furthermore, the process of preparing the amorphous composite is simple, easy to manufacture without special conditions, and is suitable for mass production.

DETAILED DESCRIPTION OF ILLUSTRATED EMBODIMENTS

The present invention will be described with reference to the specific embodiments.

Embodiment 1-18

Purity of the alloy raw materials is greater than 99.9%, and particle size of ZrC and WC nanometer powder is 10 nm. All the raw materials can be purchased from the market.

Hardness of the amorphous alloy is characterized by Vickers hardness tested by Vickers hardness tester, test method is performed according to <<GB/T 7997-2014 Hard Alloy Vickers Hardness Test Method>>, and Hardness is characterized by HV10.

The method of preparing a high hardness amorphous composite includes:

step a, weighing the basic alloy component, the hard additive and the bonding additive according to formulation ratios in Table 1, mixing the hard additive and the bonding additive evenly to obtain a mixed raw material, then placing the mixed raw material on the bottom of the basic alloy component to obtain a pending alloy raw material;

step b, smelting the pending alloy raw material by means of electric arc melting in an inert atmosphere of 0.01-0.05 MPa, and the smelting being conducted in a first process and a second process: the first process comprising controlling working current of the electric arc in 10-50 A and heating the pending alloy raw material until the pending alloy raw material melts into a liquid, the second process comprising increasing the working current of electric arc to 200-900 A to mix the liquid of the pending alloy raw material evenly; and step c, molding and cooling the liquid of the pending alloy raw material at $10^2$-$10^3$ K/s to obtain an amorphous composite ingot. The amorphous composite ingot is molded by a conventional die-casting process or a conventional suction casting process, but not limited to it.

Elemental composition and mole percent of the basic alloy component are shown in Table 1 below:

TABLE 1

| Embodiment No. | Zr | Hf | Al | Ni | Cu |
|---|---|---|---|---|---|
| 1 | 45 | 10 | 15 | 22 | 8 |
| 2 | 46 | 9 | 14 | 20 | 11 |
| 3 | 47 | 8 | 13 | 20 | 12 |
| 4 | 48 | 6 | 12 | 22 | 12 |
| 5 | 49 | 6 | 13 | 18 | 14 |
| 6 | 50 | 7 | 10 | 19 | 14 |
| 7 | 51 | 7 | 11 | 18 | 13 |
| 8 | 52 | 8 | 13 | 15 | 12 |
| 9 | 53 | 7 | 12 | 16 | 12 |
| 10 | 54 | 8 | 12 | 18 | 8 |
| 11 | 55 | 6 | 15 | 15 | 9 |
| 12 | 56 | 8 | 12 | 15 | 9 |
| 13 | 57 | 7 | 14 | 16 | 6 |
| 14 | 58 | 7 | 15 | 8 | 12 |
| 15 | 59 | 9 | 10 | 15 | 7 |
| 16 | 60 | 8 | 8 | 12 | 12 |
| 17 | 61 | 6 | 7 | 18 | 8 |
| 18 | 62 | 5 | 5 | 18 | 10 |

According to the above table 1, Zr—Al—Ni—Cu—Hf five-element alloy is prepared by conventional electric arc melting, and surface hardness of the five-element alloy without additives is tested.

When the hard additive is ZrC or WC nanometer powder with content at 12 wt % of the basic alloy component, and the bonding additive is Re with content at 8 wt % of the basic alloy component, hardness test results are shown in Table 2 below:

TABLE 2

| Embodiment No. | No Additives Hardness (Hv10) | ZrC nanometer powder + Re Hardness (HV10) | WC nanometer powder + Re Hardness (HV10) |
|---|---|---|---|
| 1 | 554 | 655 | 658 |
| 2 | 557 | 649 | 661 |
| 3 | 548 | 663 | 674 |
| 4 | 569 | 674 | 675 |
| 5 | 547 | 666 | 675 |
| 6 | 555 | 654 | 662 |
| 7 | 588 | 652 | 648 |
| 8 | 567 | 663 | 660 |
| 9 | 568 | 662 | 657 |
| 10 | 569 | 659 | 659 |
| 11 | 574 | 671 | 670 |
| 12 | 584 | 669 | 668 |
| 13 | 576 | 675 | 674 |
| 14 | 586 | 678 | 679 |
| 15 | 577 | 665 | 668 |
| 16 | 568 | 654 | 668 |
| 17 | 557 | 675 | 674 |
| 18 | 568 | 668 | 671 |

In embodiments 1-18, the amorphous composites obtained have a forming ability of equal or greater than 10 cm and a maximum forming ability of up to 22 cm. Hardness test results show that hardness and forming ability of the amorphous composite added with hard additive and bonding additive are greatly improved compared to those of the five-element alloy without additives.

Embodiment 19-32

Composition of the basic alloy component and the preparation method are the same as that of embodiment 14. Hardness test results of the amorphous composite with the different hard additive and bonding additive are shown in the Table 3 below (value is percentage of additives mass to the basic alloy component mass):

TABLE 3

| Embodiment No. | Hard additive | Bonding additive | Hardness Value (HV10) |
|---|---|---|---|
| 19 | 14% ZrC | 4% Re + 4% Mo | 685 |
| 20 | 16% ZrC | 4% Re + 2% Mo + 2% W | 671 |
| 21 | 18% ZrC | 8% Re | 667 |
| 22 | 20% ZrC | 8% Mo | 663 |
| 23 | 22% ZrC | 8% W | 652 |
| 24 | 24% ZrC | 8% Re | 641 |
| 25 | 26% ZrC | 8% Re | 628 |
| 26 | 14% WC | 4% Re + 4% Mo | 683 |
| 27 | 16% WC | 4% Re + 2% Mo + 2% W | 671 |
| 28 | 18% WC | 8% Re | 662 |
| 29 | 20% WC | 8% Mo | 658 |
| 30 | 22% WC | 8% W | 644 |
| 31 | 24% WC | 8% Re | 643 |
| 32 | 26% WC | 8% Re | 619 |

In embodiments 19-32, the amorphous composites obtained have a forming ability of equal or greater than 10 cm and a maximum forming ability of up to 22 cm. When content of hard additive nanometer powder is more than 22 wt % of the basic alloy component, hardness values of the amorphous composites decrease instead, and if the mass is over 26 wt %, no matter which kind of bonding additive is used, the amorphous composites obtained have surface cracking or bursting.

The addition of various elements as the bonding additive is superior to the addition of a single element as the bonding additive. Re and Mo elements added are better than single W element added to the ability to form amorphous composites and the ability to fuse the hard additives.

Embodiments 33-46

Composition of the basic alloy component and the preparation method are the same as those of embodiment 14. When the hard additive is ZrC nanometer powder with content at 12 wt % of the basic alloy component, the bonding additive is Re with content at 8 wt % of the basic alloy component, and B, Si or Nd also are added, the hardness test results are shown in the Table 4 below (Value is percentage of additive mass to the basic alloy component mass):

TABLE 4

| Embodiment No. | Additives | Hardness Value (HV10) |
|---|---|---|
| 33 | 0.5% B | 685 |
| 34 | 0.5% Si | 687 |
| 35 | 1% B | 689 |
| 36 | 1% Si | 688 |
| 37 | 1.5% B | 694 |
| 38 | 1.5% Si | 692 |
| 39 | 2% B | 699 |
| 40 | 2% Si | 691 |
| 41 | 1% B + 0.5% Nd | 691 |
| 42 | 1% Si + 0.5% Nd | 695 |
| 43 | 1% B + 1% Nd | 690 |
| 44 | 1% Si + 1% Nd | 687 |
| 45 | 1% B + 2% Nd | 684 |
| 46 | 1% Si + 2% Nd | 685 |

In embodiments 33-46, the addition of B and Si elements can further increase hardness of the amorphous composites, but no significant change occurs when the addition amount exceeds 2 wt %. The addition of appropriate amount of Nd element can enhance forming ability of the amorphous composites. However, forming ability of the amorphous alloys with only B or Si added does not distinct compared to the amorphous alloys without B or Si. After adding Nd, the amorphous composite is easier to form, and the forming ability can reach 22 cm.

It should be noted that, current magnitude used in the smelting process of the amorphous composite is closely related to the alloy composition added, and when addition amount of the hard additive is large, the smelting current should be increased. When addition of the bonding additive or the addition of B, Si and Nd elements is performed, the arc smelting current should be higher.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A high hardness amorphous composite, comprising:

a basic alloy component, comprising 45-60 mole % Zr, 5-10 mole % Hf, 5-15 mole % Al, 8-22 mole % Ni and 6-14 mole % Cu;

a hard additive being ZrC or WC nanometer powder with addition amount at 12-26 wt % of the basic alloy component, particle diameter of the ZrC or WC nanometer powder being 10-100 nm; and a bonding additive being any one or two selected from the group consisting of Re, W and Mo with addition amount at 4-8 wt % of the basic alloy component.

2. The high hardness amorphous composite according to claim 1, wherein the basic alloy component comprises 54-58 mole % Zr, 6-8 mole % Hf, 10-15 mole % Al, 15-20 mole % Ni and 8-12 mole % Cu.

3. The high hardness amorphous composite according to claim 1, wherein the hard additive is the ZrC nanometer powder with addition amount at 12-18 wt % of the basic alloy component.

4. The high hardness amorphous composite according to claim 1, wherein the bonding additive is Re with addition amount at 8 wt % of the basic alloy component.

5. The high hardness amorphous composite according to claim 1, further comprising B or Si with content at 0.5-2 wt % of the basic alloy component.

6. The high hardness amorphous composite according to claim 1, further comprising Nd with content at 0.5-2 wt % of the basic alloy component.

7. A method of preparing the high hardness amorphous composite according to claim 1, comprising:

step a, weighing the basic alloy component, the hard additive and the bonding additive according to formulation ratio, mixing the hard additive and the bonding additive evenly to obtain a mixed raw material, then placing the mixed raw material on bottom of the basic alloy component to obtain a pending alloy raw material;

step b, smelting the pending alloy raw material by means of electric arc smelting in an inert atmosphere of 0.01-0.05 MPa, and the smelting being conducted in a first process and a second process: the first process comprising controlling working current of electric arc in 10-50A and heating the pending alloy raw material until the pending alloy raw material melts into a liquid, the second process comprising increasing the working current of electric arc to 200-900A to mix the liquid of the pending alloy raw material evenly; and step c, molding and cooling the liquid of the pending alloy raw material at $10^2$-$10^3$ K/s to obtain an amorphous composite ingot.

8. The method of preparing the high hardness amorphous composite according to claim 7, wherein the second process is repeated one or two times.

* * * * *